US006616811B2

(12) United States Patent
Wassermann et al.

(10) Patent No.: US 6,616,811 B2
(45) Date of Patent: Sep. 9, 2003

(54) MACHINE FOR THE MANUFACTURE OF A MULTI-LAYER FIBROUS WEB

(75) Inventors: Alexander Wassermann, Vienna (AT); Manfred Feichtiger, St. Pölten (AT); Thomas Nagler, St. Pölten (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/819,771

(22) Filed: Mar. 28, 2001

(65) Prior Publication Data

US 2001/0035274 A1 Nov. 1, 2001

(30) Foreign Application Priority Data

Mar. 30, 2000 (DE) ..... 100 15 827

(51) Int. Cl.[7] ..... D21F 1/00; D21F 11/66

(52) U.S. Cl. ..... 162/304; 162/130; 162/133

(58) Field of Search ..... 162/123, 132, 162/133, 274, 298, 299, 300, 303, 304, 381, 125, 129, 130, 131, 203, 217, 301

(56) References Cited

U.S. PATENT DOCUMENTS

| | | | | | |
|---|---|---|---|---|---|
| 4,830,709 | A | * | 5/1989 | Turner et al. | 162/133 |
| 5,468,348 | A | * | 11/1995 | Blackledge et al. | 162/132 |
| 5,607,555 | A | * | 3/1997 | Grossmann et al. | 162/304 |
| 5,635,033 | A | | 6/1997 | Grossmann et al. | 162/304 |
| 6,159,341 | A | * | 12/2000 | Egelhof et al. | 162/303 |

* cited by examiner

*Primary Examiner*—Steven P. Griffin
*Assistant Examiner*—Eric Hug
(74) *Attorney, Agent, or Firm*—Taylor & Aust, P.C.

(57) ABSTRACT

A machine for the manufacture of a multi-layer fibrous web includes at least two fibrous web layers and at least two formers; the fibrous web layers each having a lower fines side with a lower fines content and a higher fines side with a higher fines content; and the formers include a first former and a second former, at least one of the two formers being a gap former, with the second former including a couch roll defining a couching zone whereat the lower fines side of the first fibrous web layer is brought into contact with the lower fines side of the second fibrous web layer.

15 Claims, 6 Drawing Sheets

MACHINE FOR THE MANUFACTURE OF A MULTI-LAYER FIBROUS WEB

BACKGROUND OF THE INVENTION

1. Field of the Invention

The present invention relates to a machine designed for the manufacture of a multi-layer fibrous web, in particular a paper or carton web, in which the layers produced by respective formers are couched together.

2. Description of the Related Art

A machine designed for the manufacture of a multi-layer fibrous web in which the layers produced by formers are couched together is described in DE 197 33 316 A1.

Several other types of former are known, such as the Fourdrinier former, the hybrid former and the so-called roll-blade gap former. In previous models of the Fourdrinier former, drainage occurs on the wire side. A concentration of fines on the top side is produced by wire mesh edge pulses. In hybrid formers, the primary drainage process occurs on the wire side. The percentage of fines on the top side is reduced by performing the drainage process in the upper wire area on the top side. In roll-blade gap formers, drainage occurs first on the top wire side and then on the bottom wire side, which produces a greater fines content on the bottom wire side. Combinations of two or more gap formers have previously been proposed. Previous embodiments of this format with two gap formers used in the packaging industry have included one system having a so-called DuoFormer Base and DuoFormer Top with the same running direction of the paper web in the sheet-forming process. In that example, the top wire side, featuring a low fines content, is couched together with the lower wire side, featuring a high fines content.

A disadvantage of the embodiments mentioned above lies in the fact that the adhesion between the two layers is too high for certain applications.

SUMMARY OF THE INVENTION

The present invention provides a machine for the manufacture of a multi-layer fibrous web. The manufacture of a multi-layer fibrous web is accomplished by feeding into the relevant couching zone at least two layers that are to be couched together, each having a lower fines content on one side, in such a way that they come into contact with each other on the sides having lower fines content. In this process, at least one of the two layers is generated by a gap former.

The present invention produces a multi-layer fibrous web with reduced adhesion between the two layers, allowing the deliberate separation of one layer of the sheet without causing the destruction of the remaining layer. A further advantage is achieved with regard to a possible alteration of the properties of the paper in terms of porosity, roughness, penetration and printing characteristics.

At least one gap former is included in the present invention, having a forming element on which a fibrous web layer is formed with higher fines content on the side of the layer facing the forming element. The forming element is preferably a forming roll.

In an embodiment of this invention, a first gap former is provided to produce a first layer and a second gap former is provided to produce a second layer. In this case, the first layer is fed by the bottom wire of the first gap former, which is separated from the top wire into a couching zone, where the sides of lower fines content of the two layers are couched together.

For practical purposes, the direction of rotation of the forming element in the second gap former is set against the direction of rotation of the forming element in the first gap former. The second layer is reversed in this case by a couch roll provided in the area of the couching zone.

In certain cases it may be advantageous for the machine to be provided with at least one Fourdrinier former, in which the sheet-forming process of the layer is effected with a higher fines content on the top side facing away from the machine wire.

In one embodiment of this invention, one Fourdrinier former is provided to produce a first layer and a second Fourdrinier former to produce a second layer, whereupon these two layers are couched together with the sides of higher fines content of each layer coming together in a first couching zone. In addition, a gap former is provided to produce a third layer, whereupon the second and the third layers are couched together with the sides of lower fines content of each layer coming together in a second couching zone.

For practical purposes, the jet direction of the headbox in the second Fourdrinier former is generally set against the jet direction of the headbox in the first Fourdrinier former. The second layer is reversed in this case by a couch roll provided in the area of the first couching zone. The third layer is, by preference, reversed by a couch roll provided in the area of the second couching zone.

In a further embodiment of this invention, one gap former is provided to produce a first layer and two Fourdrinier formers are provided to produce a second and a third layer, respectively. In this case, the second and the third layers are couched together with the sides of higher fines content of each layer coming together in a first couching zone, and the first and the second layers are couched together with the sides of lower fines content of each layer coming together in a second couching zone.

For practical purposes in this case, the jet direction of the headbox in the Fourdrinier former, which produces the third layer, is generally set against the jet direction of the headbox in the Fourdrinier former which produces the second layer.

In a further embodiment of this invention, one Fourdrinier former is provided to produce a first layer, and two gap formers are provided to produce a second and a third layer, respectively. In this case, the first and the second layer are couched together with the sides of higher fines content of each layer coming together in a first couching zone, the resulting fibrous web and the third layer are couched together with the sides of lower fines content of each layer coming together in a second couching zone.

For practical purposes in this case, the jet direction of the headbox in the gap former, which produces the second layer, is generally set against the jet direction of the headbox in the Fourdrinier former which produces the second layer. In a like manner, the jet direction of the headbox in the gap former which produces the third layer is generally set against the running direction of the first layer and the running direction of the second layer.

In a further embodiment of this invention, two gap formers are provided to produce a first and a second layer, respectively, and one Fourdrinier former is provided to produce a third layer. In this configuration, the first and the second layer are couched together with the sides of lower fines content of each layer coming together, and the second and the third layer are couched together with the sides of higher fines content of each layer coming together.

For practical purposes in this case, the jet direction of the headbox in the gap former, which produces the second layer, is generally set against the running direction of the first layer. In a like manner, the jet direction of the headbox in the Fourdrinier former which produces the third layer is generally set against the running direction of the first layer and the running direction of the second layer.

In a further embodiment of this invention, a gap former is provided to produce a first layer, a Fourdrinier former is provided to produce a second layer and another gap former is provided to produce a third layer. In this configuration, the first and the second layer are couched together with the sides of lower fines content coming together, and the second and the third layer are couched together with the sides of higher fines content coming together.

For practical purposes in this case, the jet direction of the headbox in the gap former which produces the second layer is generally set against the running direction of the first layer. In a like manner, the jet direction of the headbox in the Fourdrinier former which produces the third layer is generally set against the running direction of the first layer and the running direction of the second layer.

Each gap former may be equipped with either a single-layer or a multi-layer headbox.

Where required, constant pressure drainage elements can be provided for web drainage purposes. These may be used in combination with any of the formers. An example describing how they may be implemented can be found in document DE 197 33 316 A1.

BRIEF DESCRIPTION OF THE DRAWING

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
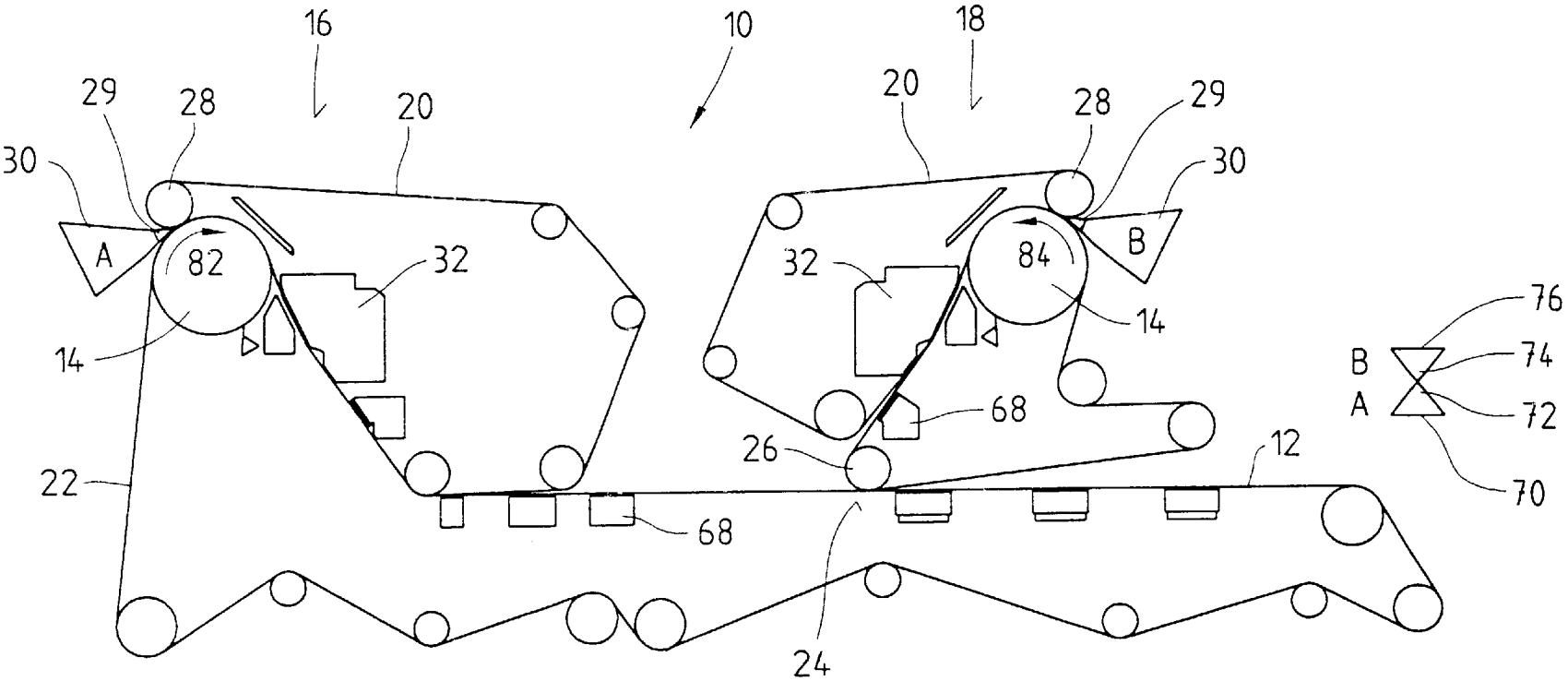
FIG. 1 is a schematic illustration of a machine designed for the manufacture of a two-layer fibrous web with two gap formers.

Referring now to the drawings, and more particularly to FIGS. 1–6, there is shown respectively, machine 10 designed for the manufacture of multi-layer fibrous web 12, in which layers produced by their respective formers are couched together. Multi-layer fibrous web 12 is especially likely to be a paper or carton web.

In this process, at least two of layers A and B or B and C are couched together with each layer featuring a lower fines content on one side, are fed into the respective couching zone in such a way that they come into contact with each other on the sides of lower fines content. Each of FIGS. 1–6 contain a symbol of at least two triangles with a letter to the left of each triangle. The letter corresponds to the layer of the fibrous web and the horizontal member of each triangle represents a side of the layer with higher fines content, and the angled end opposite the horizontal member represents a side of the layer with lower fines content.

In one case, at least one of the two layers is generated by a gap former 16, 18, 40 which contains forming element 14, that preferably is a forming roll, in which the sheet-forming of layers A, B, C is effected with a higher fines content on the side of forming element 14. Each gap former 16, 18, 40 includes two endless, circulating drainage screens, which run together in such a way as to form intake slot 29 for the fibrous mixture and which are guided over forming element 14, in the area of fibrous material intake slot 29. Outer drainage screen 20 is guided onto forming element 14 via breast roll 28. Fibrous mixture intake slot 29 is loaded by headbox 30 with pulp slurry. Within the loop of outer drainage screen 20, forming block 32 is positioned in immediate proximity to forming element 14.

In the embodiment depicted in FIG. 1, first gap former 16 is provided to produce first layer A and second gap former 18 is provided to produce second layer B. First layer A is fed into couching zone 24 by bottom wire 22 separated from top wire 20 of first gap former 16. Here, layers A and B are couched together with their sides of lower fines content coming into contact.

The direction of rotation 84 of forming element 14 in second gap former 18 is set against the direction of rotation 82 of forming element 14 in first gap former 16. Second layer B is reversed by couch roll 26 provided in the area of couching zone 24.

The resulting distribution of fines is depicted in symbol form on the right of FIG. 1 with low fine side 72 of first layer A in contact with low fines side 76 of second layer B.

Figure 2:
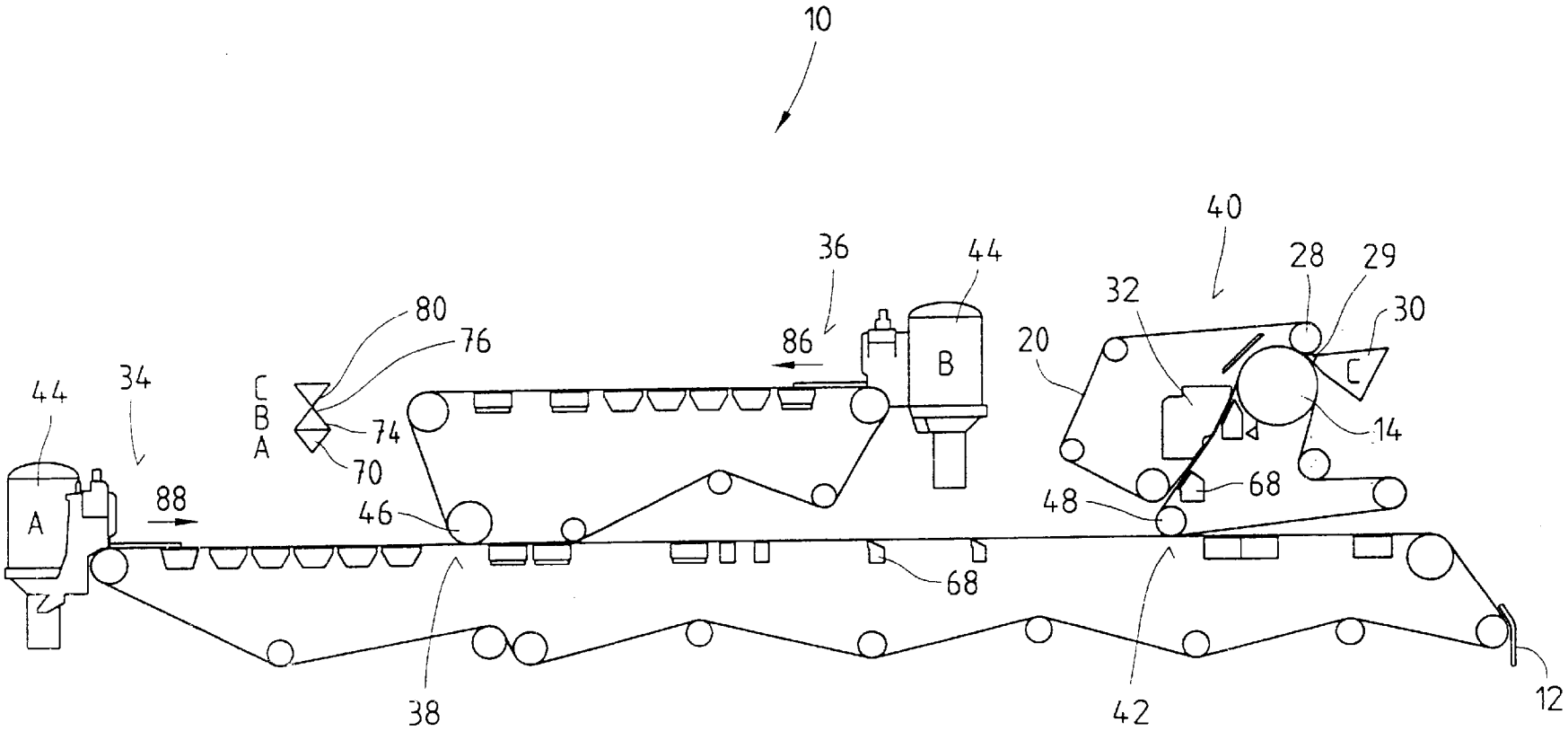
FIG. 2 is a schematic illustration of a machine designed for the manufacture of a three-layer fibrous web with two Fourdrinier formers to produce the first two layers and one gap former to produce the third layer.

FIG. 2 shows a second embodiment of the machine in which first layer A is produced by Fourdrinier former 34 and second layer B is produced by Fourdrinier former 36. Layers A and B former 40 is provided to produce third layer C. Second layer B and third layer C are couched together with their sides of lower fines contents coming together in second couching zone 42.

The jet direction 88 of headbox 44 in second Fourdrinier former 36 is generally set against the jet direction 86 of headbox 44 in first Fourdrinier former 34. Second layer B is reversed by couch roll 46 provided in the area of first couching zone 38.

Third layer C is reversed by couch roll 48 provided in the area of second couching zone 42.

The resulting distribution of fines is depicted in symbol form on the left side of FIG. 2 with high fines side 70 of first layer A in contact with high fines side 74 of second layer B and low fines side 76 of second layer B in contact with low fines side 80 of third layer C.

Figure 3:
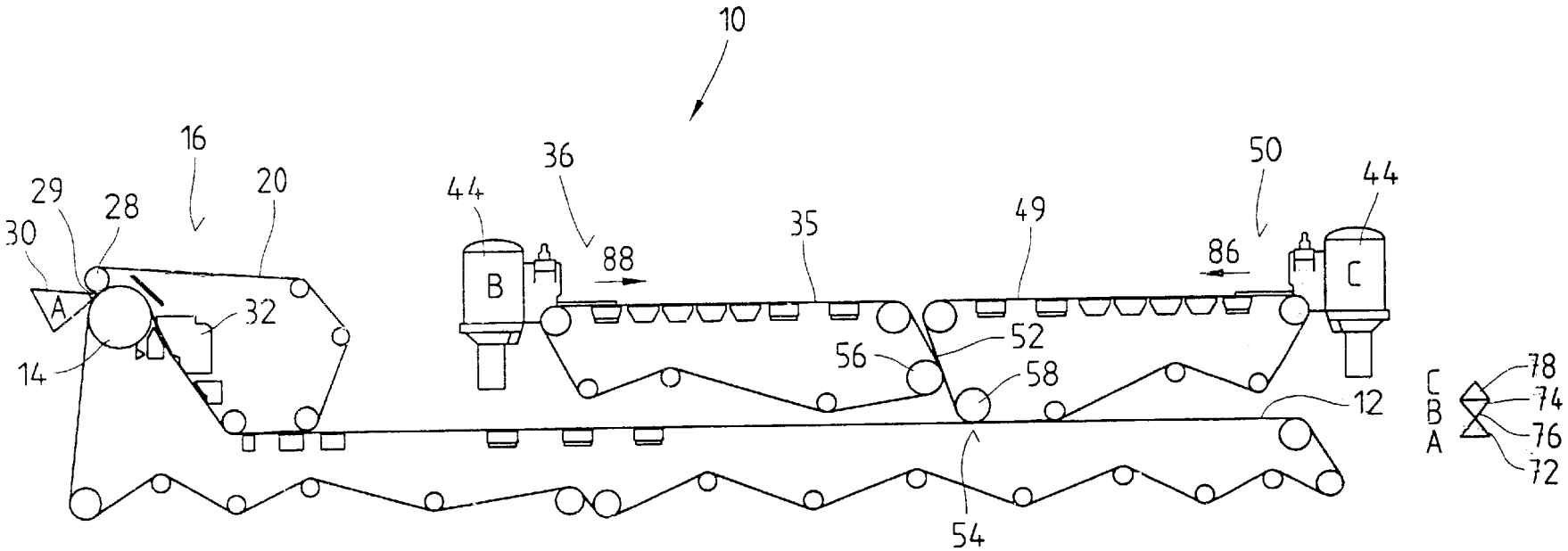
FIG. 3 is a schematic illustration of a machine designed for the manufacture of a three-layer fibrous web with one gap former to produce the first layer and two Fourdrinier formers to produce the second and third layers.

FIG. 3 shows an additional embodiment of machine 10 in which first layer A is produced by gap former 16 and second layer B and third layer C are produced by Fourdrinier formers 36 and 50, respectively. Second layer B and third layer C are couched together in first couching zone 52 with the sides of higher fines content coming together and first layer A and second layer B are couched together with the sides of lower fines content coming together in second couching zone 54.

The jet direction 91 of headbox 44 Fourdrinier former 50 which produces third layer C is generally set against the jet direction 88 of headbox 44 in Fourdrinier former 36 which produces second layer B.

In the area of couching zone 52, wire 35 of Fourdinier former 36 is guided over couch roll 56. In the area of couching zone 54, wire 49 of Fourdrinier former 50 is guided over couch roll 58.

The resulting distribution of fines is depicted in symbol form on the right of FIG. 3 with low fines side 72 of first layer A in contact with low fines side 76 of second layer B and high fines side 74 of second layer B in contact with high fines side 78 of third layer C.

Figure 4:
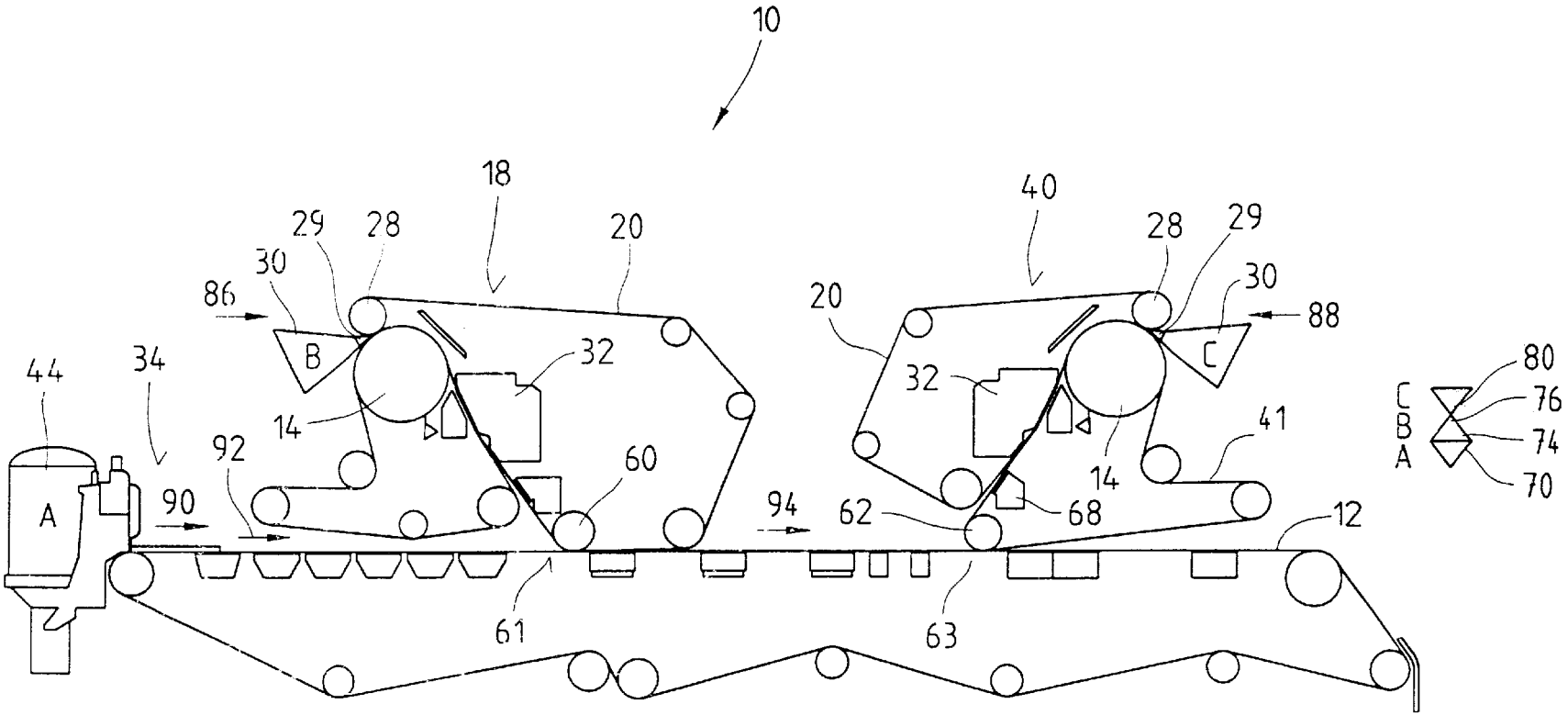
FIG. 4 is a schematic illustration of a machine designed for the manufacture of a three-layer fibrous web with one Fourdrinier former to produce the first layer and two gap formers to produce the second and third layers.

FIG. 4 shows an additional embodiment of machine 10 in which a first layer is produced by Fourdrinier former 34, and second layer B and third layer C are produced by gap formers 18 and 40, respectively. First layer A and second layer B are couched together with the sides of higher fines content coming together, and second layer B and third layer C are couched together with the sides of lower fines content coming together.

The jet direction 85 of headbox 30 in gap former 18, which produces second layer B, generally corresponds to the jet direction 86 of headbox 44 in Fourdrinier former 34, which produces first layer A. The jet direction 90 of headbox 30 in gap former 40 which produces third layer C is generally set against the running direction 92 of first layer A and the running direction 94 of second layer B.

In the area of couching zone 61, top wire 20 of gap former 18 is guided over couch roll 60. In the area of couching zone 63, bottom wire 41 of gap former 40 is guided over couch roll 62.

The resulting distribution of fines is depicted in symbol form on the right of FIG. 4 with high fines side 70 of first layer A in contact with high fines side 74 of second layer B and low fines side 76 of second layer B in contact with low fines side 80 of third layer C.

Figure 5:
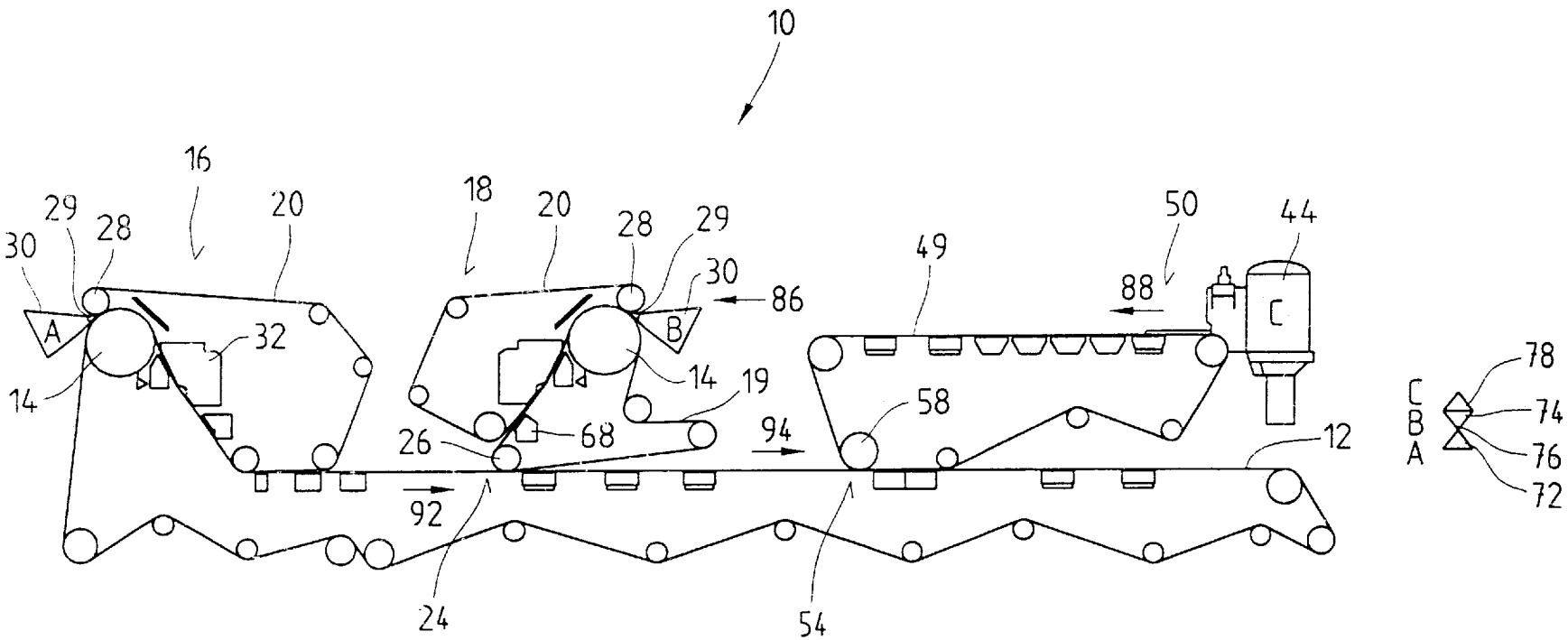
FIG. 5 is a schematic illustration of a machine designed for the manufacture of a three-layer fibrous web with two gap formers to produce the first and second layers and one Fourdrinier former to produce the third layer.

FIG. 5 shows an additional embodiment of machine 10 in which first layer A and second layer B are produced by gap former 16 and 18, respectively, and third layer C is produced by Fourdrinier former 50. First layer A and second layer B are couched together with the sides of lower fines content coming together, and second layer B and third layer C are couched together with the sides of higher fines content coming together.

The jet direction 85 of headbox 30 in gap former 18 which produces second layer B is generally set against the running direction 92 of first layer A. The jet direction 91 of headbox 44 in Fourdrinier former 50 which produces third layer C is generally set against the running direction 92 of first layer A and the running direction 94 of second layer B.

In the area of couching zone 24, bottom wire 19 of gap former 18 is again guided over couch roll 26. Wire 49 of Fourdrinier former 50 is guided over couch roll 58 in the area of couching zone 54.

The resulting distribution of fines is depicted in symbol form on the right of FIG. 5 with low fines side 72 of first layer A in contact with low fines side 76 of second layer B and high fines side 74 of second layer B in contact with high fines side 78 of third layer C.

Figure 6:
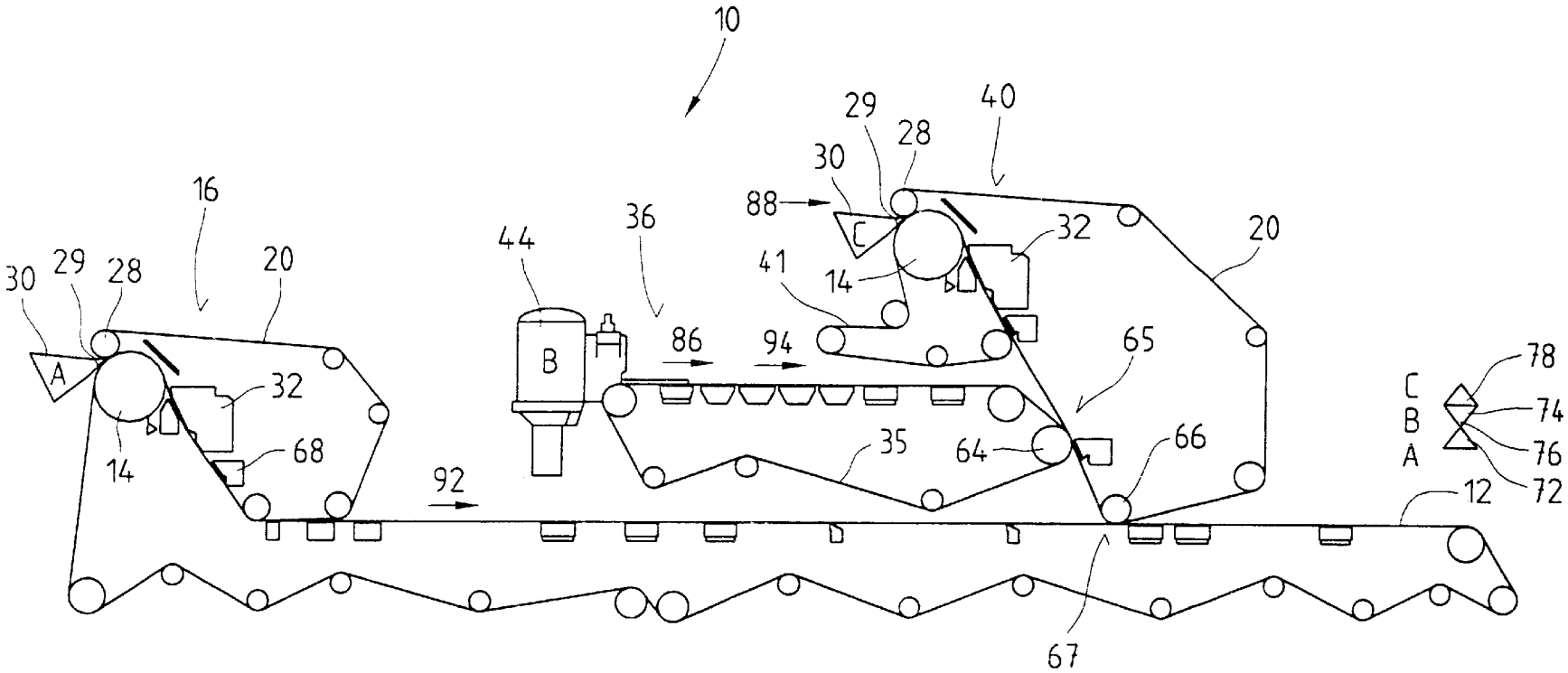
FIG. 6 is a schematic illustration of a machine designed for the manufacture of a three-layer fibrous web with one gap former to produce the first layer, one Fourdrinier former to produce the second layer and one gap former to produce the third layer.

FIG. 6 shows an additional embodiment of machine 10 in which first layer A is produced by gap former 16, second layer B is produced by Fourdrinier former 36 and third layer C is produced by second gap former 40. In this case, second layer B and third layer C are couched together with the sides of higher fines content coming together and, subsequently, first layer A and second layer B are couched together with the sides of lower fines content coming together.

The jet direction 88 of headbox 44 in Fourdrinier former 36 which produces second layer B generally corresponds to the running direction 92 of first layer A. The jet direction 90 of headbox 30 in gap former 40, which produces third layer C, generally corresponds to the running direction 92 of first layer A and the running direction 94 of second layer B.

In the area of couching zone 65, wire 35 of Fourdrinier former 36 is guided over couch roll 64. Top wire 20 of gap former 40 is guided over couch roll 66 in the area of couching zone 67.

The resulting distribution of;fines is depicted in symbol form on the right of FIG. 6 with low fines side 72 of first layer A in contact with low fines side 76 of second layer B and high fines side 74 of second layer B in contact with high fines side 78 of third layer C.

Each of gap formers 16, 18, 40 may be provided with either a multi-layer headbox or a single layer headbox.

Where required, constant pressure drainage elements 68 can be provided for web drainage purposes. These may be used in combination with bottom wire 22 or gap formers 16, 18, 40, or Fourdrinier formers 34, 36, 50.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine for the manufacture of a multi-layer fibrous web, comprising:

at least two fibrous web layers, including a first fibrous web layer, and a second fibrous web layer, each of said first fibrous web layer and said second fibrous web layer having a lower fines side with a lower fines content and a higher fines side with a higher fines content; and at least two formers including a first former forming said first fibrous web layer and a second former forming said second fibrous web layer, at least one of said at least two formers being a gap former, said second former including a couch roll defining a first couching zone whereat said lower fines side of said first fibrous web layer is brought into contact with said lower fines side of said second fibrous web layer, at least one of said at least two formers is a Fourdrinier former having a machine wire configured such that said higher fines side of said at least two fibrous web layers is formed facing away from said machine wire.

2. A machine for the manufacture of a multi-layer fibrous web, comprising:

at least two fibrous web layers, including a first fibrous web layer, and a second fibrous web layer, each of said first fibrous web layer and said second fibrous web layer having a lower fines side with a lower fines content and a higher fines side with a higher fines content; and at least three formers including a first former forming said first fibrous web layer, a second former forming said second fibrous web layer and a third former for forming a third fibrous web layer, said second former including a couch roll defining a first couching zone whereat said lower fines side of said first fibrous web layer is brought into contact with said lower fines side of said second fibrous web layer, said third fibrous layer having a lower fines side with a lower fines content and a higher fines side with a higher fines content, said first former and said second former being Fourdrinier formers, said third former being a gap former, said second former being configured for couching said higher fines side of said first fibrous web layer and said higher fines side of said second fibrous web layer together in said first couching zone, and said third former including a couch roll defining a second couch zone configured for couching said lower fines side of said second fibrous web layer and said lower fines side of said third fibrous web layer together in said second couching zone.

3. The machine of claims 2, wherein said first former and said second former each include a headbox, the jet direction of said headbox in said second former being generally set against the jet direction of said headbox in said first former and said couch roll of said second former being configured to reverse said second fibrous web layer.

4. The machine of claim 2, wherein said third former includes a couch roll configured for reversing said third fibrous web layer.

5. A machine for the manufacture of a multi-layer fibrous web, comprising:

at least two fibrous web layers, including a first fibrous web layer, and a second fibrous web layer, each of said first fibrous web layer and said second fibrous web layer having a lower fines side with a lower fines content and a higher fines side with a higher fines content; and at least three formers including a first former forming said first fibrous web layer, a second former forming said second fibrous web layer and a third former for forming a third fibrous web layer, said second former including a couch roll defining a first couching zone whereat said lower fines side of said first fibrous web layer is brought into contact with said lower fines side of said second fibrous web layer, said first former being a gap former, said second former and said third former each being Fourdrinier formers, said formers being configured for couching said higher fines side of said second fibrous web layer and said higher fines side of said third fibrous web layer together and for couching said lower fines side of said first fibrous web layer and said lower fines side of said second fibrous web layer together.

6. The machine of claim 5, wherein said second former and said third former each include a headbox, the jet direction of said headbox in said third former being generally set against the jet direction of said headbox in said second former.

7. A machine for the manufacture of a multi-layer fibrous web, comprising:

at least two fibrous web layers, including a first fibrous web layer, and a second fibrous web layer, each of said first fibrous web layer and said second fibrous web layer having a lower fines side with a lower fines content and a higher fines side with a higher fines content; and at least three formers including a first former forming said first fibrous web layer, a second former forming said second fibrous web layer and a third former for the forming a third fibrous web layer, said second former including a couch roll defining a first couching zone whereat said lower fines side of said first fibrous web layer is brought into contact with said lower fines side of said second fibrous web layer, said first former being a Fourdrinier former, said second former and said third former being gap formers, said formers being configured for couching said higher fines side of said first fibrous web layer and said higher fines side of said second fibrous web layer together and for couching said lower fines side of said second fibrous web layer and said lower fines side of said third fibrous web layer together.

8. The machine of claim 7, wherein said second former includes a headbox having a jet direction generally corresponds to a running direction of said first fibrous web layer.

9. The machine of claim 7, wherein said third former includes a headbox having a jet direction generally set against a running direction of said first fibrous web layer and said second fibrous web layer.

10. A machine for the manufacture of a multi-layer fibrous web, comprising:

at least two fibrous web layers, including a first fibrous web layer, and a second fibrous web layer, each of said first fibrous web layer and said second fibrous web layer having a lower fines side with a lower fines content and a higher fines side with a higher fines content; and at least three formers including a first former forming said first fibrous web layer, a second former forming said second fibrous web layer and a third former for the forming a third fibrous web layer, said second former including a couch roll defining a first couching zone whereat said lower fines side of said first fibrous web layer is brought into contact with said lower fines side of said second fibrous web layer, said first former and said second former each being gap formers; and said third former being a Fourdrinier former, said formers configured for couching said lower fines side of said first fibrous web layer and said lower fines side of said second fibrous web layer together and for couching said higher fines side of said second fibrous web layer and said higher fines side of said third fibrous web layer together.

11. The machine of claim 10, wherein said second former includes a headbox having a jet direction generally set against a running direction of said first fibrous web layer.

12. The machine of claim 10, wherein said third former includes a headbox having a jet direction generally set against a running direction of said first fibrous web layer and said second fibrous web layer.

13. A machine for the manufacture of a multi-layer fibrous web, comprising:

at least two fibrous web layers, including a first fibrous web layer, and a second fibrous web layer, each of said first fibrous web layer and said second fibrous web layer having a lower fines side with a lower fines content and a higher fines side with a higher fines content; and at least three formers including a first former forming said first fibrous web layer, a second former forming said second fibrous web layer and a third former for forming a third fibrous web layer, said second former including a couch roll defining a first couching zone whereat said lower fines side of said first fibrous web layer is brought into contact with said lower fines side of said second fibrous web layer, said first former and said third former being gap formers, and said second former being a Fourdrinier-former, said formers configured for couching said higher fines side of said second fibrous web layer and said higher fines side of said third fibrous layer together and for couching said lower fines side of said first fibrous web layer and said lower fines side of said second fibrous web layer together.

14. The machine of claim 13, wherein said second former includes a headbox having a jet direction generally corresponding to a running direction of said first fibrous web layer.

15. The machine of claim 13, wherein said third former includes a headbox having a jet direction generally corresponding to a running direction of said first fibrous web layer and said second fibrous web layer.

* * * * *

UNITED STATES PATENT AND TRADEMARK OFFICE

CERTIFICATE OF CORRECTION

PATENT NO. : 6,616,811 B2
DATED : September 9, 2003
INVENTOR(S) : Wassermann et al.

It is certified that error appears in the above-identified patent and that said Letters Patent is hereby corrected as shown below:

Title page,
Item [75], Inventors, delete "Vienna", and substitute therefore, -- Wien --; and delete "Feichtiger", and substitute therefore -- Feichtinger --.
Item [56], References Cited, add the following: -- FOREIGN PATENT DOCUMENTS 197 33 316 A1 2/1999 Germany ……..B21/F1/00 --.

Column 4,
Line 53, after "A and B", please insert the following: -- are coached together with their sides of higher fines content in first couching zone 38. Gap --.

Column 9,
Line 5, delete "Fourdrinier-former", and substitute therefore -- Fourdrinier former --.

Signed and Sealed this

Sixth Day of July, 2004

JON W. DUDAS
*Acting Director of the United States Patent and Trademark Office*